US006311787B1

(12) United States Patent
Berry et al.

(10) Patent No.: US 6,311,787 B1
(45) Date of Patent: Nov. 6, 2001

(54) POWER DRIVEN ROTARY DEVICE

(75) Inventors: Robert A. Berry, Mt. Airy; Stephen A. Debelius, Phoenix, both of MD (US); Frank O'Hara, Hanover, PA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/551,444

(22) Filed: Apr. 18, 2000

(51) Int. Cl.[7] ..... B25B 17/00

(52) U.S. Cl. ..... 173/176; 173/178; 173/216; 81/57.11; 81/59.1; 192/223.2

(58) Field of Search ..... 173/176, 178, 173/216, 217, 181, 93.5; 81/57.1, 57.11, 57.14, 57.31, 59.1, 474, 469; 192/223.2, 41 R, 4 LI

(56) References Cited

U.S. PATENT DOCUMENTS 3,243,023 * 3/1966 Boyden ..... 192/223.2
4,834,192 * 5/1989 Hansson ..... 173/178
5,016,501 * 5/1991 Holzer, Jr. ..... 81/57.11
5,271,471 * 12/1993 Sasaki ..... 173/178
5,653,294 * 8/1997 Thurler ..... 173/216
5,947,254 * 9/1999 Jones ..... 192/223.2
5,984,022 * 11/1999 Harman, Jr. et al. ..... 173/176

* cited by examiner

*Primary Examiner*—Scott A. Smith
(74) *Attorney, Agent, or Firm*—Charles E. Yocum

(57) ABSTRACT

A drill 30 for driving a bit 44 into a workpiece 50 includes an assembled anvil 58 and spindle 38, which are mounted for rotation together and for axial movement together within a drill housing 32. A planet carrier 56 is driven by a motor 52 and, in turn rotatingly drives the anvil 58 and the spindle 38. A chuck 42 is attached to a forward end of the spindle 58 for rotation and axial movement therewith. A plurality of rollers 162 are mounted in nests 182 of a roller cage 176, are maintained in parallel with an axis of the drill 30, and the anvil 58. The rollers 162, which are included in an automatic spindle lock 33, can be wedged between a fixed surface 74 of the drill housing 32 and a movable surface 102 of the anvil for automatically locking the spindle 38 with the housing. Following withdrawal of the bit 44 from the workpiece 50, an automatic brake 35 provides facility for braking the spindle 38. When the planet carrier 56 ceases to be driven, the anvil 58 and the spindle 38 are in a coasting mode relative to the slowing speed of the planet carrier 56. An automatic drag system 37 provides a drag between the coasting anvil 58 and the planet carrier 56 to bring the coasting speed of the anvil generally in line with the slowing speed of the planet carrier.

40 Claims, 9 Drawing Sheets

POWER DRIVEN ROTARY DEVICE

BACKGROUND OF THE INVENTION

This invention relates to a power driven rotary device, and particularly relates to a power driven rotary tool with spindle lock, brake and drag systems.

Power driven rotary devices drive a variety of different tools or bits for performing various work-related operations on a workpiece. For example, such devices are used to drill a hole, driving a threaded member, form and shape portions of a workpiece, and the like. Typically, a power-operated rotary tool or device includes a power driver and transmission, a spindle rotated by the power driver, and a bit-holder, such as a chuck, mounted onto a forward end of the spindle. When the tool is to be used, a tool bit, such as a drill bit, is mounted in the chuck with a working end of the tool bit extending outward from the chuck at a working end of the tool. The spindle, the chuck and the drill bit are rotated by the power driver, while the working end of the drill bit is being urged into the workpiece.

The chuck may include several clamping jaws which are radially and axially movable along paths within the chuck to converge clamping surfaces of the jaws into a clamping position about portions of a shank of the drill bit which has been positioned in axial alignment within the chuck.

In one type of chuck, referred to as a keyless chuck, an outer ring of the chuck can be rotated by the user to move the jaws and thereby clamp, or unclamp, the drill bit relative to the chuck. In using a keyless chuck, the main body of the chuck must be prevented from rotating while the ring is rotated by the user to effect the desired operation of the jaws. With the chuck mounted to the spindle of the tool, any attempt to rotate the ring of the chuck while holding the chuck body to prevent rotation of the body is a difficult task.

To assist the user of the tool in rotating the ring of a keyless chuck, while precluding any rotation of the chuck body, an automatic spindle lock was developed many years ago, an example of which is described and illustrated in U.S. Pat. No. 3,243,023, which issued on Mar. 29, 1966.

The automatic spindle lock includes several wedging rollers which are contained within a housing of the tool to facilitate the locking of the spindle, and thereby the chuck body, to the housing at any time when operating power is not being applied to the tool. This will assist the operator in adjusting the jaws of the chuck in the process of clamping, or unclamping, any bit with respect to the chuck.

The wedging rollers are each formed with an axis which, desirably, should be parallel with an axis of the spindle, and is spaced from the other rollers in a circular path about the spindle axis. Each of the rollers is located within a respective chamber which allows the rollers to be moved desirably laterally of the axis thereof within the circular path, resulting in a slight lost motion between the rollers and the spindle. Also, the rollers are allowed to move in a radial direction relative to the spindle axis, while desirably maintaining the parallel relationship with the spindle axis. Each chamber includes interfacing, radially spaced boundaries formed by a radially outboard fixed surface which is associated with the housing, and by an inboard surface which is associated with the spindle.

The rollers are mounted for passive movement in the circular path when power is being applied to the tool to rotate the spindle and the chuck in a rotational mode. When power is not being applied to the tool, the spindle and the chuck are not rotating and are in a non-rotational mode.

If, during the non-rotational mode, the operator desires to clamp, or unclamp, the bit with respect to the chuck, the operator holds the housing with one hand, and slightly turns the chuck in either direction whereby the rollers become wedged between the fixed surface of the housing and the inboard surface of the spindle to effectively and automatically lock the spindle and the chuck with the housing. While continuing to hold the housing with the one hand, the operator turns the ring on the keyless chuck to facilitate clamping, or unclamping, movement of the jaws thereof, to allow the bit to be retained with, or be removable from, the chuck.

While it is desirable that the axes of the rollers be maintained in parallel with the spindle axis as noted above, the rollers are occasionally skewed from the axial alignment due to the limited freedom of movement of the rollers within their respective chambers. Consequently, some portions of the skewed rollers may not be not fully wedged in place when the operator adjusts the chuck to effect the automatic locking of the spindle with the housing, thereby lowering the integrity of such automatic locking.

In view of this deficiency, there is a need for a facility for insuring that, in the automatic locking of the spindle to the housing, each roller is wedged fully in place, with the axis thereof being in parallel with the spindle axis, to obtain the maximum automatic locking possible.

When the tool is in operation, and the operating power is removed therefrom, the power driver begins to coast to a stop and, after a brief down-coasting period, eventually ceases to rotate. Due to the built-in lost motion noted above, the spindle tends to continue to rotate for a brief period at or near the normal operational speed, which is faster than the down-coasting speed of the power driver.

During the brief down-coasting period, the faster spindle moves slightly ahead of the slowing power driver to the extent that the wedging rollers become wedged whereafter a reactive force, resulting from an impact engagement of the faster spindle and the slowing power driver, causes the rollers to become unwedged. This condition can occur several times during the down-coasting period where the rollers may skew as noted above, and where the facing portions of the power driver, spindle and rollers repeatedly and engagingly interact to develop an undesirable chattering noise.

Therefore, there is a further need for a facility for reducing or eliminating the conditions which lead to the undesirable chattering noise, to thereby reduce or eliminate such noise.

SUMMARY OF THE INVENTION

It is, therefore, an object of the invention to provide a rotary tool having an automatic spindle lock with facility for obtaining a high integrity locking of a spindle of the tool to a housing of the tool.

Another object of this invention is to provide a rotary tool having an automatic brake and/or an automatic drag system with facility for reducing or eliminating conditions which lead to any undesirable chattering noise, to thereby reduce or eliminate such noise, either alone or in combination with the automatic spindle lock.

With these and other objects in mind, this invention contemplates a power driven rotary device, which includes a housing having at least one fixed wedging surface, a drive carrier mounted for rotation within the housing, a powered driver located within the housing for rotating the drive carrier, a drivable output member formed with an axis and located within the housing and mounted therein for rotation. The drivable output member includes at least one movable wedging surface located in spatially facing relation to the fixed wedging surface, and the drive carrier rotates the drivable output member upon rotation of the drive carrier. At least one wedging element is formed with an axis and is located for free movement between the fixed wedging surface and the at least one movable wedging surface for movement with the drive carrier and the drivable output member when the drive carrier and the drivable output member are rotating at substantially the same speed. The at least one wedging element can also be wedged between the fixed wedging surface and the at least one movable wedging surface in a wedging mode when the drivable output member is rotating at a speed different from the speed of the drive carrier to lock the drivable output member with the housing. Means are provided for maintaining the axis of the at least one wedging element in a prescribed orientation relative to the axis of the drivable output member.

This invention further contemplates A power driven rotary device, which includes a housing, a drive carrier mounted for rotation within the housing, a powered driver located within the housing for rotating the drive carrier, and a drivable output member having at least portions located within the housing and mounted therein for rotation. The drive carrier is movable into engagement with, and for rotating, the drivable output member upon rotation of the drive carrier. A drag surface is located on at least a portion of the drivable output member which is in engagement with an adjacent portion of the drive carrier to present a drag on the rotational movement of the drivable output member when the speed of the drivable output member is different from the speed of the drive carrier.

Additionally, this invention contemplates a power driven rotary device, which a housing, a drive carrier mounted for rotation within the housing, a powered driver located within the housing for rotating the drive carrier, and a drivable output member having at least portions located within the housing and mounted therein for rotation. The drive carrier is movable into engagement with, and for rotating, the drivable output member upon rotation of the drive carrier. Means responsive to the drivable output member being in an unloaded mode is provided for applying a braking force to the drivable output member, and means responsive to the drivable output member being in a loaded mode is provided for removing the braking force from the drivable output member.

Other objects, features and advantages of the present invention will become more fully apparent from the following detailed description of the preferred embodiment, the appended claims and the accompanying drawings.

DETAILED DESCRIPTION OF THE PREFERRED EMBODIMENT OF THE INVENTION

Figure 1:
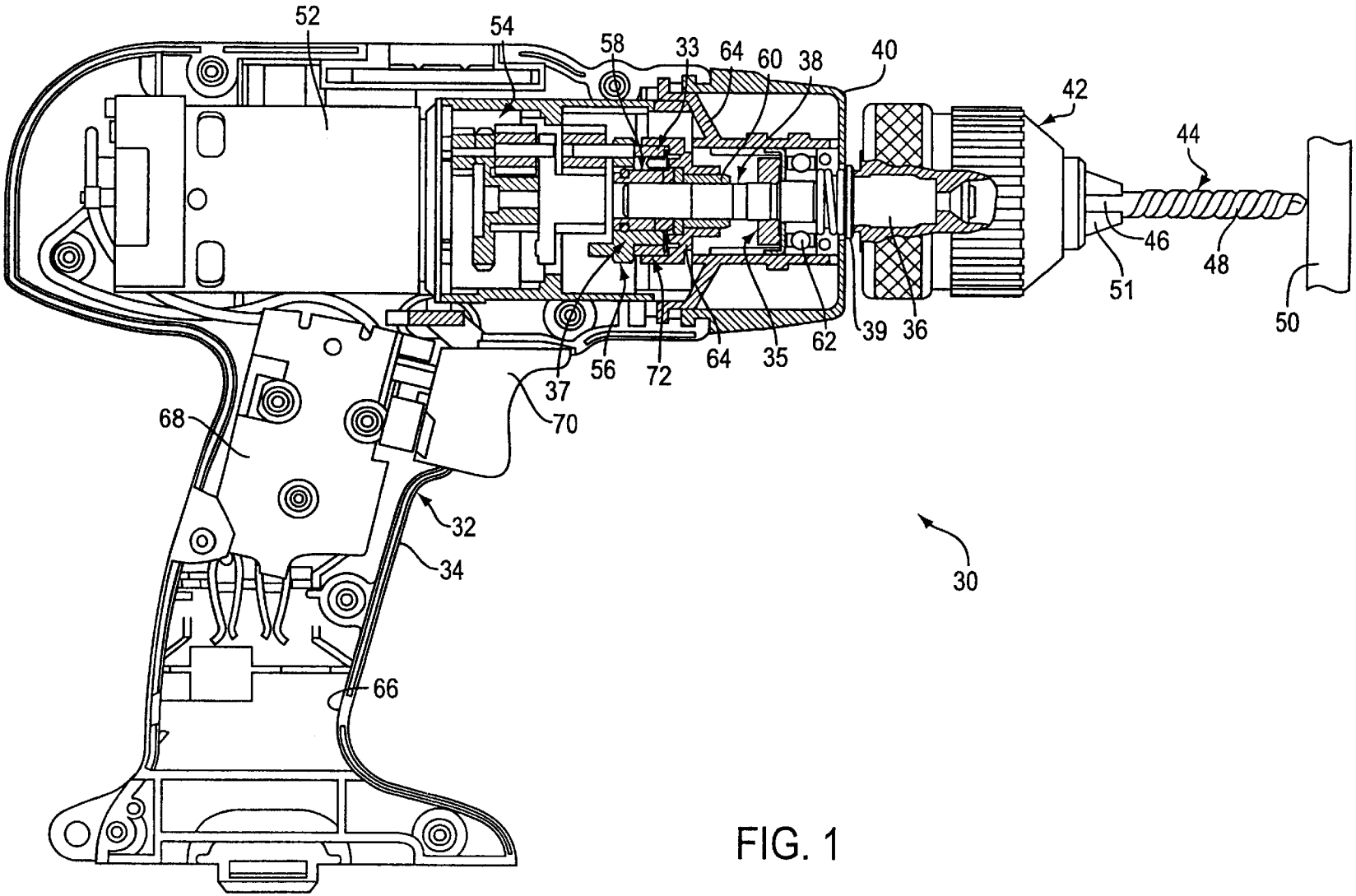
FIG. 1 is a sectional side view of a tool showing an automatic spindle lock, an automatic brake and an automatic drag system, all in accordance with certain principles of the invention.
Figure 2:
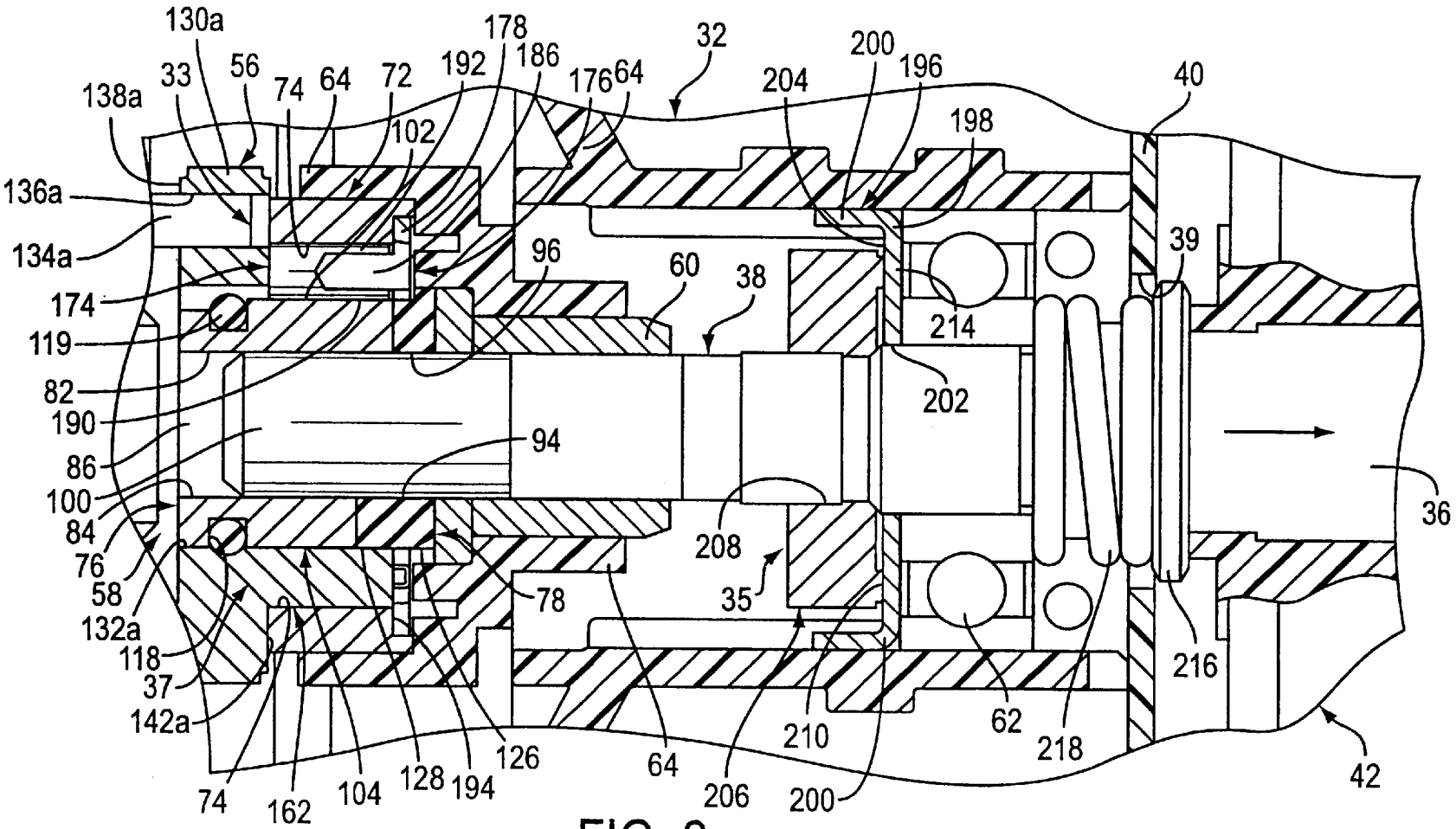
FIG. 2 is a partial and enlarged view of a portion of FIG. 1 showing details of the automatic spindle lock, brake and drag systems, in accordance with certain principles of the invention.

As shown in FIG. 1, one embodiment of a power driven rotary device could be, for example, a tool such as that illustrated as a drill 30. The drill 30 includes a housing 32 composed of two clam-shell sections 34, one of which has been removed to reveal the internal elements of the drill, including an automatic spindle lock 33, an automatic brake 35 and an automatic drag system 37. Referring to FIGS. 1 and 2, a forward or working end 36 of an output member, such as, for example, a spindle 38, extends along an axis of the spindle, forward and outward through an axial opening 39 of a forward nosepiece 40 of the drill 30 and has a bit holder, such as a chuck 42, attached thereto for rotation and axial movement therewith. A working element, such as, for example, a drill bit 44, is formed with a shank 46 which is held within the chuck, and a forward or working end 48 formed, for example, with a drilling profile, which is positioned for forming or drilling a hole in a workpiece 50. The drill bit 44 can be held with the chuck 42, for example, by adjustable jaws 51 of the chuck, which are selectively clamped about the shank 46 of the bit.

The power driven rotary device could be tools other than the drill 30 without departing from the spirit and scope of the invention. For example, the tool could be a screwdriver, a router bit driver, or any rotary driver which rotates a working element.

A powered driver, such as a motor 52, is mounted within the housing 32, and is drivingly coupled to the spindle 38, through a gear transmission 54, a drive carrier, such as, for example, a first embodiment of a planet carrier 56, and a drivable output member, which includes a coupler, such as, for example, a first embodiment of an anvil 58. The anvil 58 is axially positioned about and attached to the spindle 38 for rotational and axial movement therewith, which could also be included as an element of the drivable output member. A bushing 60 and an axially spaced bearing 62 are fixedly assembled within a skeleton frame 64, which is an integral part of the interior of the housing 32, and provide an axial mount for rotation of the spindle 38. The bushing and the bearing 62 also serve as a pair of spaced supports for supporting the anvil 58 and the spindle 38 for axial movement relative thereto.

As shown in FIG. 1, a power compartment 66 is formed in a lower handle portion of the housing 32 for receipt of an electrical battery (not shown), through an opening at the base of the handle portion, to provide a cordless source of operating power for the motor 52. A switch 68 is mounted in an upper handle portion of the housing 32, and is controllable by a conventional trigger element 70 to facilitate control of the switch by an operator, to thereby supply operating power to, or remove such power from, the motor 52.

It is noted that the drill 30 could also be powered from a corded source of operating power without departing from the spirit and scope of the invention.

Referring to FIG. 2, a band-like ring 72 (FIG. 12) is located about, and in axial alignment with, the axis of the spindle 38 and is fixedly attached within the housing 32 by being press fit into a nest formed by the interior skeleton frame 64 of the housing. The ring 72 forms an inner, circular surface 74 which is non-rotatable and is located about, and faces, the common axis of the spindle and the drill 30. At least portions of the ring inner surface 74 form a fixed wedging surface of the housing during a wedging mode. The ring 72 is also shown in FIGS. 9 through 14.

Figure 7:
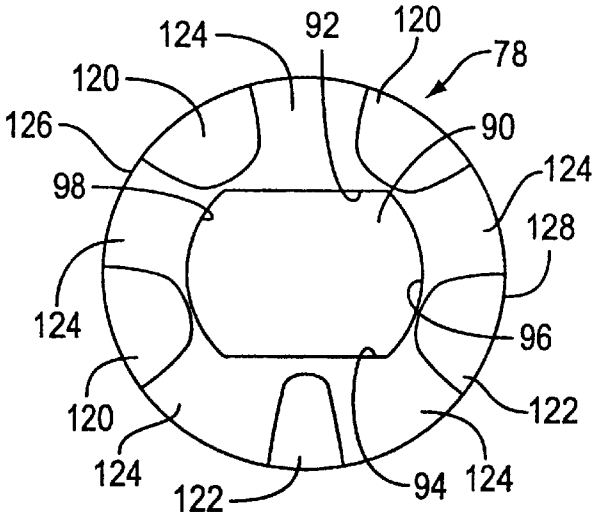
FIG. 7 is an end view showing additional details of the second section of the anvil of FIG. 5, in accordance with certain principles of the invention.
Figure 6:
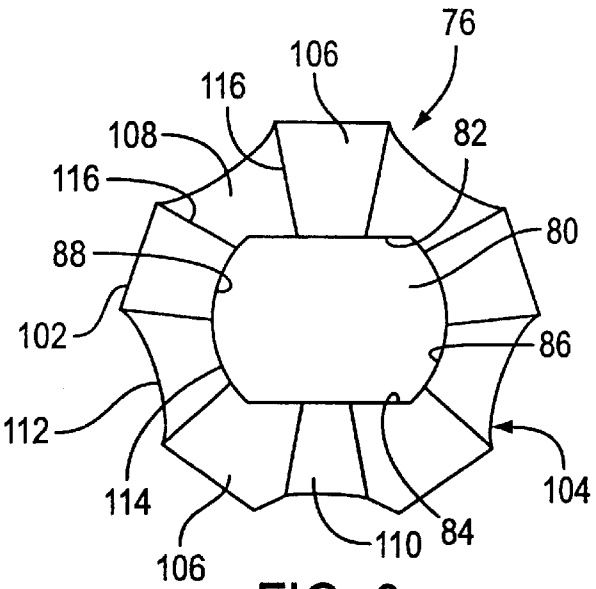
FIG. 6 is an end view showing still further details of the first section of the anvil of FIG. 3, in accordance with certain principles of the invention.

The anvil 58 is formed by two elements, a metal element 76 and a compliant element 78, which could be composed of rubber or any other suitable compliant material. As shown in FIG. 6, the metal element 76 of the anvil 58 is formed with a central axial opening 80 having a pair of spaced interfacing flat surfaces 82 and 84, and a pair of spaced interfacing concave surfaces 86 and 88. As shown in FIG. 7, the compliant element 78 of the anvil 58 is formed with a central axial opening 90 having a pair of spaced interfacing flat surfaces 92 and 94, and a pair of spaced interfacing concave surfaces 96 and 98. When the elements 76 and 78 are joined to form the anvil 58, an axial opening is formed through the anvil which has the profile of openings 80 and 90, and which fits axially about a complementary peripheral surface portion 100 of the spindle 38 as illustrated in FIG. 2.

Figure 3:
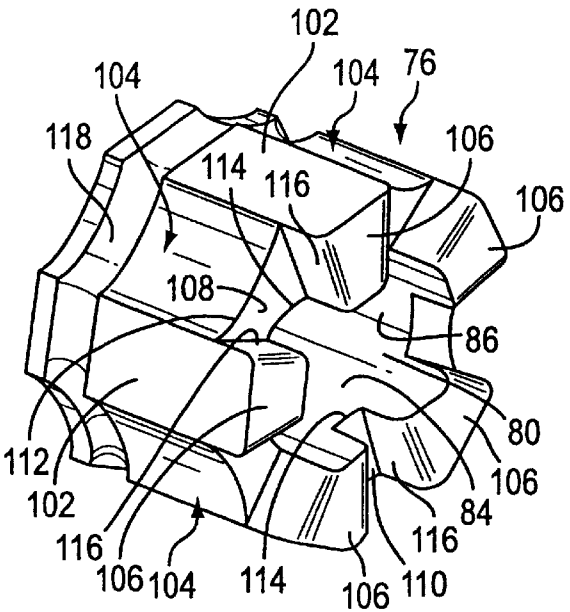
FIG. 3 is a perspective view showing details of a first section of a first embodiment of a two-section anvil of the tool of FIG. 1, in accordance with certain principles of the invention.

As shown in FIGS. 3 and 6, the metal element 76 is formed with five spaced flat surfaces 102 on the outer periphery thereof, portions of each of which form a movable wedging surface during the wedging mode. Five concave drive-finger receptor surfaces 104 are formed on the outer periphery of the metal element 76 and extend between adjacent respective pairs of the flat surfaces 102. Five lugs 106 are formed on an inboard end of the metal element 76 and extend in an axial direction from the portions of the metal element which are common to respective ones of five flat surfaces 102.

Figure 4:
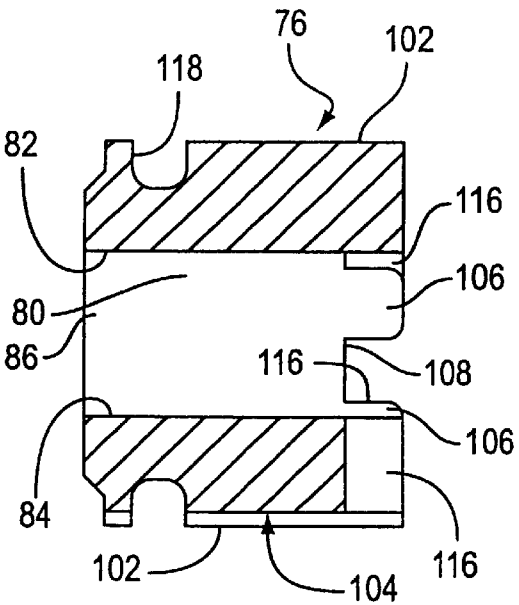
FIG. 4 is a sectional view showing other details of the first section of the anvil of FIG. 3, in accordance with certain principles of the invention.
Figure 16:
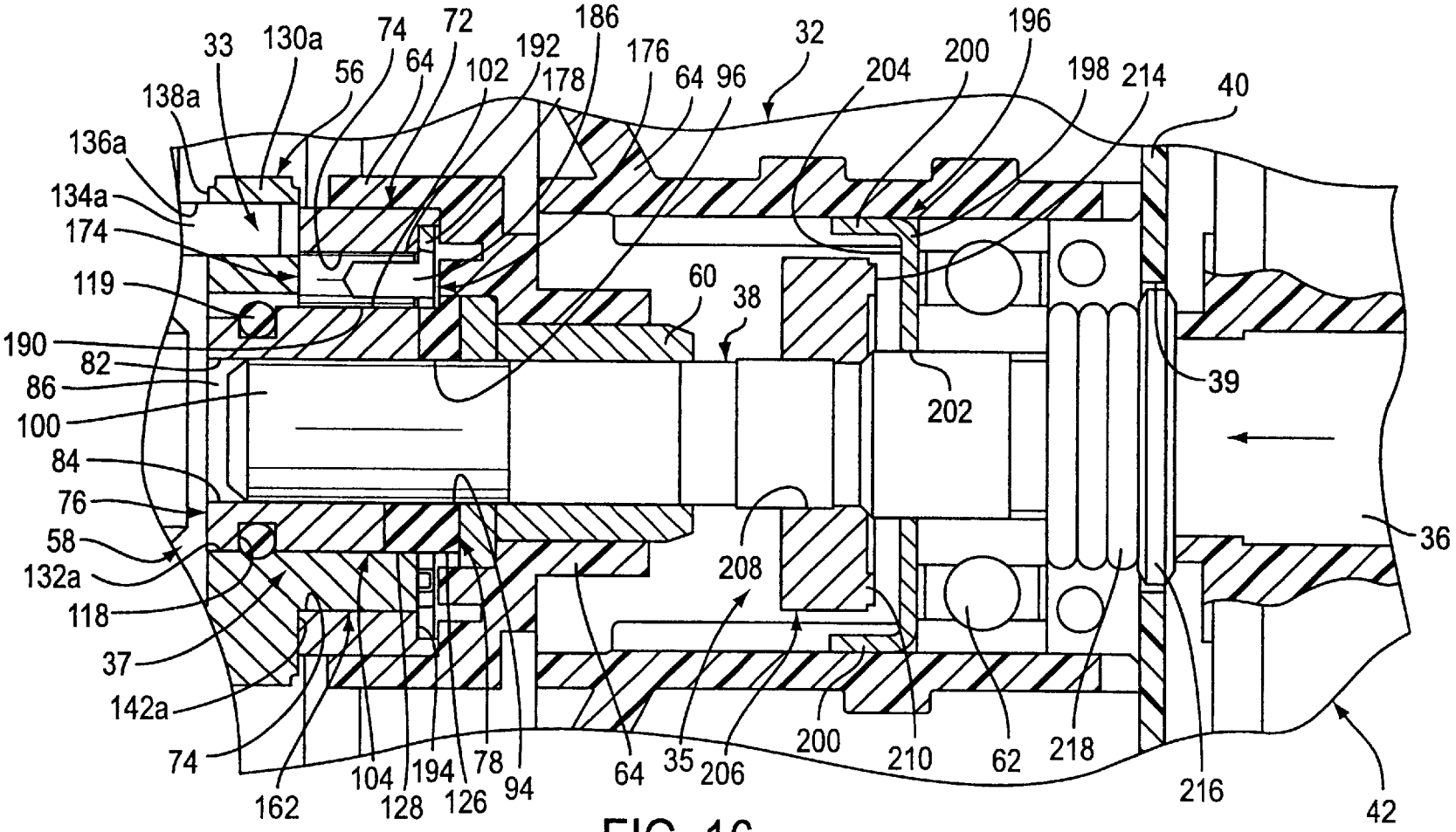
FIG. 16 is a partial and enlarged view, similar to FIG. 2, showing the automatic brake system in a brake-release condition, in accordance with certain principles of the invention.

Four spaces 108 of generally common width, shape and depth are formed between adjacent respective pairs of the lugs 106, while a fifth space 110 of smaller width is formed between a respective adjacent pair of the lugs 106. Each of the spaces 108 and 110 is formed with an outer edge 112 which is contiguous with a respective one of the concave receptor surfaces 104, and a lower edge 114 which is contiguous with the opening 80. Also, each of the spaces 108 and 110 are formed with spaced sidewalls 116 which taper toward each other as the sidewalls extend from the outer edge 112 to the lower edge 114. As shown in FIGS. 3 and 4, an annular groove 118 is formed in the outer peripheral surface of the metal element 76 near an outboard end thereof for eventual receipt of a band such as, for example, a compliant O-ring 119, as illustrated in FIGS. 2 and 16, which could be composed of rubber or any other suitable compliant material.

Figure 5:
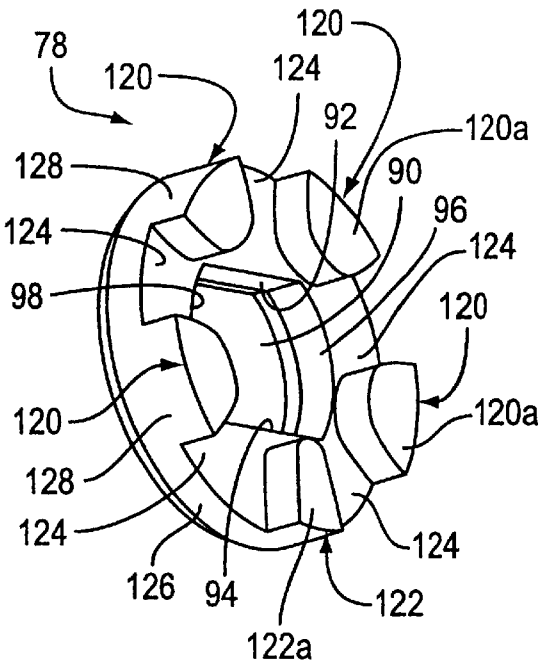
FIG. 5 is a perspective view showing details of a second section of the anvil of the tool of FIG. 1, in accordance with certain principles of the invention.

As shown in FIGS. 5 and 7, the compliant element 78 is formed on an inboard end thereof with four spaced lugs 120 of generally common width, shape and height in an axial direction, and a fifth lug 122 of smaller width. Five spaces 124 are formed between adjacent respective pairs of the lugs 120 and 122. The compliant element 78 is formed with a circular peripheral surface 126 which extends axially to form circular outer surfaces 128, referred to as drag surfaces, of the lugs 120 and 122.

In the formation of the anvil 58, the inboard ends of the metal element 76 and the compliant element 78 are assembled in interfacing engagement. In this manner, the four lugs 120 of the compliant element 78 are inserted into the four spaces 108 of the metal element 76, and the fifth lug 122 of the compliant element is inserted into the fifth space 110 of the metal element. Also, the lugs 106 of the metal element 76 are inserted into the spaces 124 of the compliant element 78. When the assembly of the metal element 76 and the compliant element 78 has been completed, the outer surfaces of the lugs 106, 120 and 122 are fully and snugly seated within the respective spaces 124, 108 and 110, with all interfacing surfaces being in engagement. In this manner, the anvil 58 presents an integral and unitary structural appearance, a portion of which is metal and a portion of which is compliant.

By facility of the smaller widths of the space 110 and the lug 122, the inboard ends of the metal element 76 and the compliant element 78 can only be assembled in a single orientation, which insures that the metal element 76 and the compliant element 78 are always properly aligned and assembled in the formation of the anvil 58.

It is noted that when the metal element 76 and the compliant element 78 are assembled, radially outward portions 120*a* and 122*a* of the lugs 120 and 122, respectively, will be radially outward from the concave receptor surfaces 104, and will form, in effect, end walls of radially inward chambers, the base or floor of which are formed by the receptor surfaces. With this arrangement, the circular outer surfaces 128, or drag surfaces, of the lugs 120 and 122 will be located radially outward from the concave receptor surfaces 104.

Figure 15:
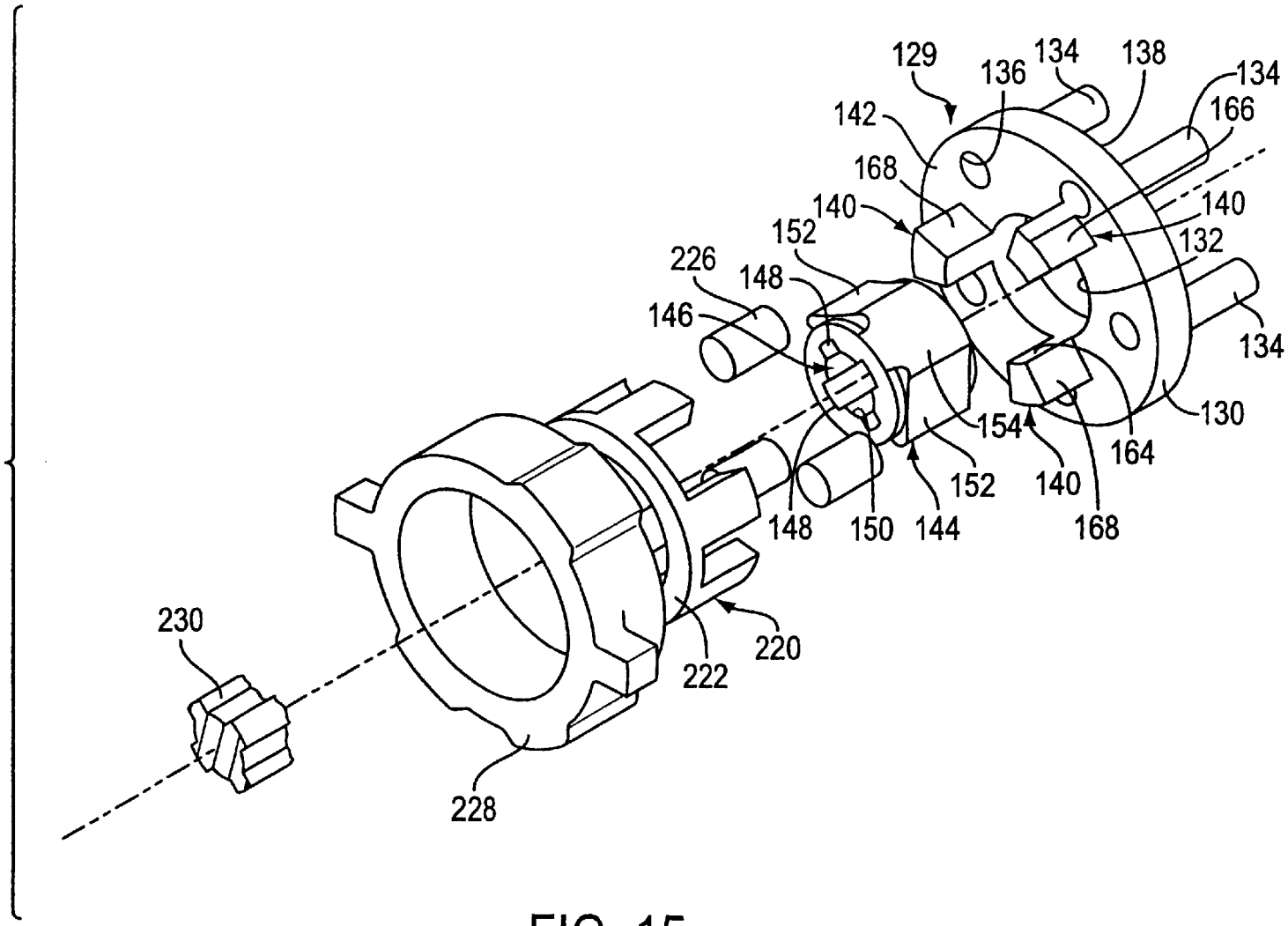
FIG. 15 is a perspective view showing a second embodiment of an automatic spindle lock, in accordance with certain principles of the invention.

As shown in FIG. 15, another drive carrier, such as a second embodiment of a planet carrier 129, is formed by a circular plate 130 with a central opening 132, and a plurality of spaced, transmission-coupling pins 134 assembled within spaced respective openings 136 formed in the plate in a circular path about an axis of the opening. The pins 134 extend from a first major face 138 of the plate 130 in an axial direction toward the motor 52 (FIG. 1), and are coupled to the transmission 54 (FIG. 1) for the coupling of rotary driving power from the motor to the planet carrier 129. The second-embodiment planet carrier 129 is also formed with three drive fingers 140, which extend from a second major surface 142 of the plate 130 in an axial direction opposite the axial direction of the pins 134.

The structure of the first-embodiment planet carrier 56 is similar to the structure of the second-embodiment planet carrier 129, except that the first-embodiment planet carrier is formed with five drive fingers 162 (FIGS. 2 and 12), instead of the three drive fingers 140 (FIG. 15) of the carrier 129. Also, the cross-sectional structure of the five drive fingers 162 of the first-embodiment planet carrier 56 is different from that of the three fingers 140 of the second-embodiment planet carrier 129.

For example, as shown in FIG. 15, the three drive fingers 140 are each formed with a slightly concave surface 164 which faces the axis of the planet carrier 129, and a convex surface 166 spaced radially outward from the concave surface. A pair of flat spaced side surfaces 168 extend between the concave and convex surfaces 164 and 166, and diverge as the side surfaces extend in a direction outward from the axis of the planet carrier 129.

Figure 14:
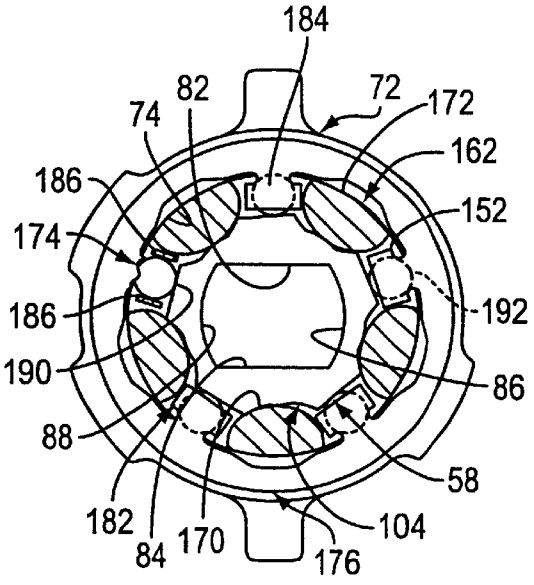
FIG. 14 is an end view showing the assembled roller cage, rollers, fixed ring and drive fingers, shown in section, of FIG. 12, in a spindle-locked position, in accordance with certain principles of the invention.
Figure 13:
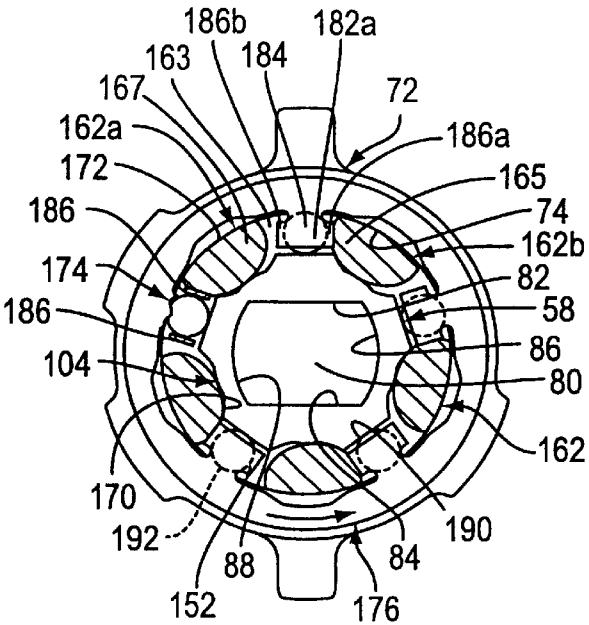
FIG. 13 is an end view showing the assembled roller cage, rollers, fixed ring and drive fingers, shown in section, of FIG. 12, in a motor-engaged position, in accordance with certain principles of the invention.
Figure 12:
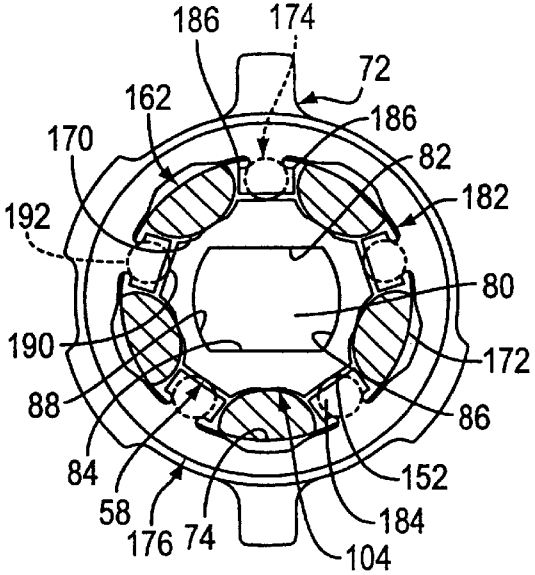
FIG. 12 is an end view showing the roller cage, rollers and fixed ring of FIG. 9 in assembly with drive fingers, shown in section, of a planet carrier of the tool of FIG. 1, all in a free position, in accordance with certain principles of the invention.

On the other hand, as shown in FIGS. 12, 13 and 14, each of the five fingers 162 of the first embodiment planet carrier 56 is formed with a radially inward-facing first convex surface 170, and a radially outward-facing second convex surface 172. Also, as shown in FIGS. 12, 13 and 14, the convexity of the portions of the convex surface 170 of each of the fingers 162, which nest in the concave receptor surfaces 104 of the anvil 58, nearly complement the concavity of the receptor surfaces to facilitate the general seating of selected portions of the convex surface 170 within three selected portions of the receptor surfaces when the fingers are in respective In FIGS. 2 and 16, the elements of the first embodiment planet carrier 56, which are similar to the corresponding elements of the second embodiment planet carrier 129, are numbered with the same numbers, but with the letter "a" following thereafter. For example, in FIGS. 2 and 16, the circular plate of the first embodiment planet carrier 56 is identified by the alpha-numeric combination of "130*a*."

Figure 9:
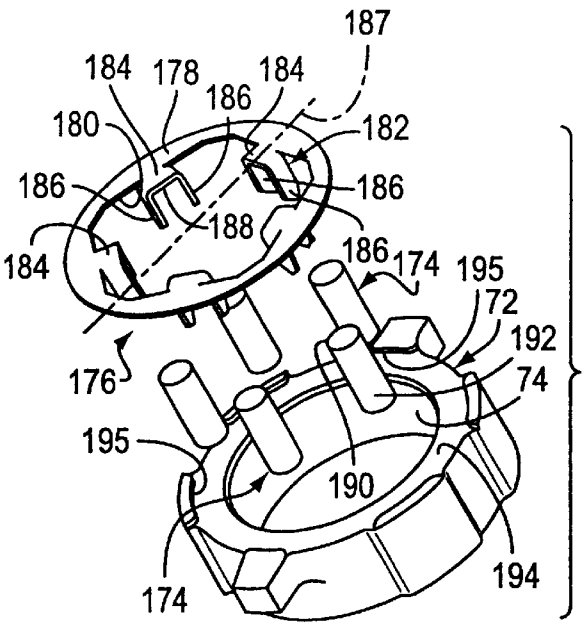
FIG. 9 is an exploded perspective view showing a roller cage, rollers and a fixed ring of the automatic lock system of FIG. 1, in accordance with certain principles of the invention.

Referring to FIG. 9, five rollers 174 form a plurality of wedging elements, each extending along a wedging-element axis thereof, which facilitate the automatic locking of the spindle 38 with the housing 32. A roller cage 176 is formed by a support member, such as ,for example, a flat ring 178 having a central opening 180 formed about an axis of the ring. Five nests 182 of the roller cage 176 are each formed by (1) a respective ear 184 formed with, and extending inward from an inner side wall of, the ring 178 in the plane thereof, and (2) a pair of parallel spaced fingers 186 which are joined with, and extend in a common axial direction from opposite sides of, the respective ear. The parallel fingers 186 of each pair of fingers are located equally on opposite sides of a respective radial centerline 187, as illustrated in FIG. 9 with respect to one of the five pairs, and are not aligned radially with the axis of the ring 178. This off-radial alignment of the fingers 186 facilitates the support of each of the rollers 174 such that at least one of a plurality of sets of an inner peripheral surface 190 and an outer peripheral surface 192 (FIG. 9), which are located on diametrically opposite sides of the roller, and which extend axially between opposite ends of the roller, are in radial alignment with the axis of the ring 178.

Figure 10:
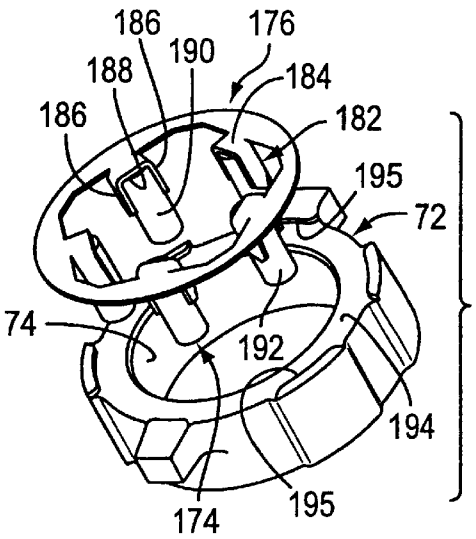
FIG. 10 is a perspective view showing the rollers and roller cage of FIG. 9 in assembly and spaced from the fixed ring, in accordance with certain principles of the invention.

While each roller 174 is pinched between its respective pair of fingers 186, as shown in FIG. 10, each roller may rotate about its axis, during operation of the drill 30, and during operation of the automatic spindle lock 33, when the roller is being moved between the various positions shown in FIGS. 12, 13 and 14. During such movement of the rollers 174, a different set of two diametrically-opposed peripheral surfaces 190 and 192 of each roller will be radially aligned with the axis of the ring 178.

As shown in FIG. 10, the rollers 174 are inserted into respective ones of the nests 182 such that one end of each roller seats against an inside surface 188 of the ear 184, and the peripheral surfaces of the rollers are pinch-gripped between the parallel fingers 186, as noted above. In this manner, the rollers 174 are held in a prescribed orientation where the axes of the five rollers are maintained in a parallel relation with each other, and with the axis of the ring 178, and ultimately the axis of the anvil 58. Also, the inner peripheral surface 190 of each of the rollers 174 which faces the axis of the ring 178, and the outer peripheral surface 192 of each of the rollers which faces away from the axis of the ring, is fully exposed, between opposite ends thereof, and unencumbered by the fingers 186 of the nests 182.

Thus, the roller cage 176 and the nests 182 form a means for maintaining the axis of each of the rollers 174 in the prescribed orientation, that is, parallel, relative to the axis of the anvil 58, and to the axes of the other rollers. In addition, each of the fingers 186 forms a blocking member which precludes transaxial movement of the respective rollers 174 in the direction of the blocking member.

Figure 11:
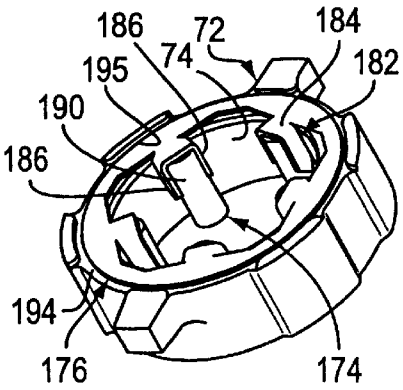
FIG. 11 is a perspective view showing the roller cage, rollers and the fixed ring of FIG. 9 in full assembly, in accordance with certain principles of the invention.

As shown in FIGS. 2, 9, 10 and 11, the ring 72 is formed with a ledge 194 which is positioned for receipt of the flat ring 178 of the roller cage 176. Also, the ring 72 is formed with six spaced shoulders 195 which are contiguous with the ledge 194, and which face radially inward of the ring. Referring to FIG. 11, the roller cage 176 is in assembly with the ring 72 such that the flat ring 178 of the roller cage is in interfacing engagement with the ledge 194 of the ring 72, the nested rollers 174 are located within the ring 72, and the outer side surface 192 (FIG. 10) of each roller is fully in an interfacing position with the inner circular surface 74 of the ring 72, but slightly spaced therefrom. Also, the roller cage 176 is assembled with the ring 72 for independent rotational movement relative to the ring, and will remain in this condition when all elements of the drill 30 have been assembled within the housing 32.

Figure 18:
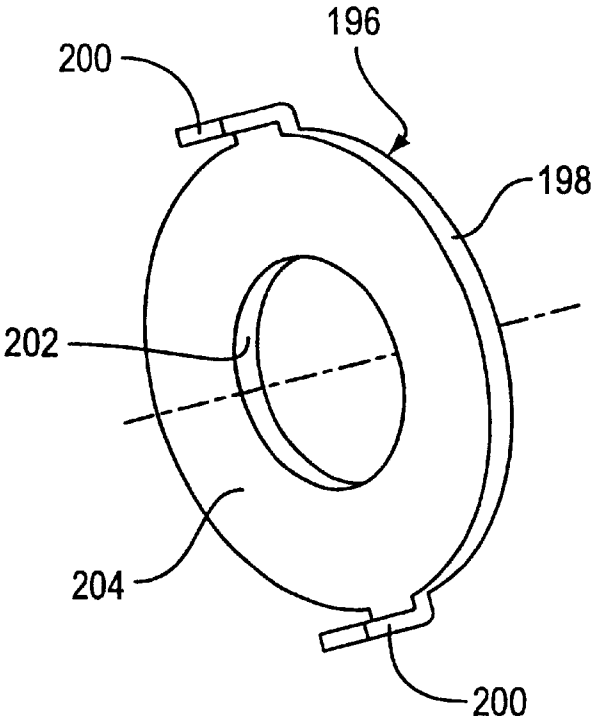
FIG. 18 is a perspective view showing a brake disk of the automatic brake system of FIGS. 1, 2 and 16, in accordance with certain principles of the invention.
Figure 17:
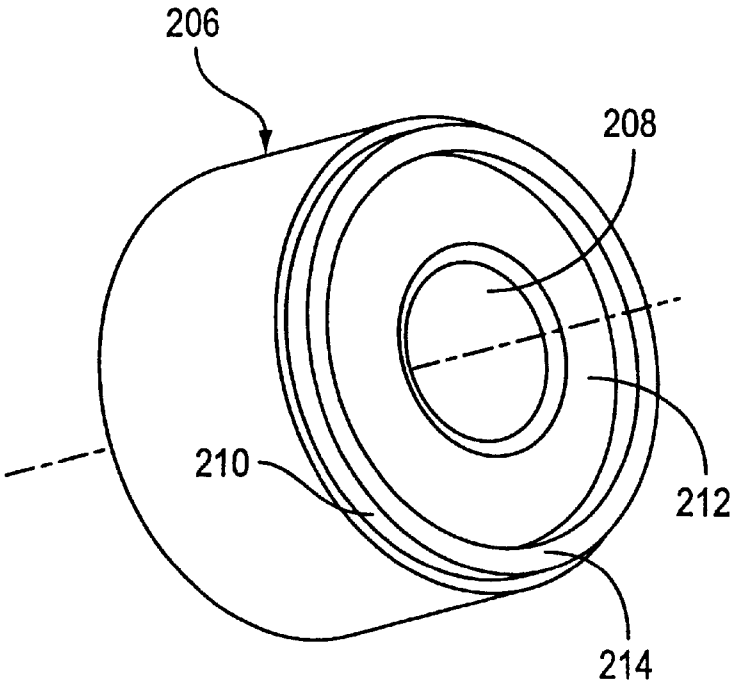
FIG. 17 is a perspective view showing a brake collar of the automatic brake system of FIGS. 1, 2 and 16, in accordance with certain principles of the invention

As shown in FIG. 18, and with regard to the automatic brake 35, a brake disk 196, having a relatively thin axial thickness, is formed with a flat, circular washer-like plate 198. A pair of diametrically-opposed ears 200 are formed on opposite sides of the plate 198, and extend in a common axial direction. The plate 198 is further formed with a central opening 202 and a brake surface 204. As shown in FIG. 17, a brake collar 206 is formed with an axial thickness greater than the axial thickness of the plate 198, and with a central opening 208. A circular ring-like brake pad 210 extends from an end face 212 of the brake collar 206 and is formed with a brake surface 214 which ultimately interfaces with the brake surface 204 of the brake disk 196.

Referring to FIGS. 2 and 16, the spindle 38 is formed with an annular limiting collar 216 for eventual engagement with one end of a compression spring 218, with the opposite end of the spring eventually being positioned for engagement with the bearing 62. The bushing 60, the bearing 62, the ring 72 and the ears 200 of the brake disk 196, are all fixedly assembled with the frame 64 internally of the housing 32, by positioning the ears 200 in a pair of diametrically opposed slots 219 formed in the housing frame. The spindle 38 is mounted in the bushing 60 and the bearing 62 for axial and rotational movement relative thereto.

The brake collar 206 is fixedly assembled on the spindle 38 for axial and rotational movement therewith, while the spring 218 is positioned about the spindle and is captured between a fixed location within the housing 32, i.e., a forward side of the bearing 62, and the annular limiting collar 216 which is formed on the spindle. The spindle 38 is normally urged axially forward, in the direction of the arrow illustrated on the working end 36 thereof, by the biasing force of the expanding spring 218 against the annular collar 216. As the spindle 38 is normally urged in the forward direction, the brake surface 214 of the brake collar 206 is urged into engagement with the brake surface 204 of the brake disk 196 for the application of a braking force in opposition to the rotation of the spindle. Also, the engagement of the brake surface 214 with the brake surface 204 precludes any further movement of the spindle 38 in the forward direction. Even though the engagement between the brake disk 196 and the brake collar 206 limits the forward axial movement of the spindle 38, a rear end 221 of the chuck 42 serves as a stop which is positioned in the path of movement of the limiting collar 216 to limit the distance the drivable output member can be urged in the forward direction.

Referring to FIG. 1, when the working end 48 of the drill bit 44 has a back force applied thereto, for example, when the working end is pressed against the workpiece 50, the spindle 38 is moved rearward, as illustrated in FIG. 16, in the direction of the arrow on the working end 36 of the spindle. As further shown in FIG. 16, as the spindle 38 is moved rearward, the brake collar 206 is moved away from the brake disk 196 to allow the spindle 38 and the drill bit 44 to be rotated, unencumbered by engagement of the brake collar with the brake disk. Also, as the spindle 38 is moved rearward, the annular collar 216 is allowed to move into the larger opening 39 of the nosepiece 40. With the rearward movement of the annular collar 216, the spring 218 is compressed and loaded essentially fully for eventually providing the biasing force necessary to move the spindle 38 in the forward direction when the back force is removed from the drill bit 44.

The automatic brake 35 of the drill 30 is includes (1) the spring 218, as captured between the bearing 62, which is fixed to the housing 32, and the annular collar 216 on the spindle 38, (2) the brake disk 196, which is fixed to the housing, (3) the brake collar 206, which is fixed to the spindle 38, and (4) the spindle being mounted in the fixed bushing 60 and the fixed bearing for forward and rearward axial movement relative to the bushing and the bearing. A means responsive to the anvil 58 and the spindle 38 being driven in an unloaded rotational mode for applying a braking force to the anvil and the spindle includes the bearing 62, the brake disk 196, the brake collar 206, the annular collar 216 and the spring 218. A means responsive to the anvil 58 and the spindle 38 being driven in a loaded rotational mode for removing the brake force from the anvil and the spindle includes the axial movability of the spindle and the attachment of the brake collar thereto.

At the rearward end of the spindle 38, the anvil 58 is press fit onto the spindle, as illustrated in FIG. 2, and the assembly (FIG. 11) of the rollers 174, the roller cage 176 and the ring 72 is moved into position where the ring 72 is press fit into the internal frame 64 of the housing 32. At the same time, each of the rollers 174 assumes a position in engagement with a respective one of the flat surfaces 152 of the anvil 58, and between the respective flat surface and the inner circular surface 74 of the ring 72. In this position, each roller 174 is in engagement with the respective flat surface 152 of the anvil 58, but is normally spaced slightly from the inner circular surface 74 of the ring 72, except during a "spindle locking" or wedging mode as described below. This arrangement allows limited free movement of the rollers 174, radially between the inner circular surface 74 of the ring 72 and the respective flat surfaces 152 of the anvil 58 during a non-wedging mode. Also, the rollers 174 are desirably positioned such that the axis of each roller is parallel with the axes of the remaining rollers and with the axis of the anvil 58, and thereby with the axis of the spindle 38. The parallel positioning of the rollers 174, as described, is maintained by the parallel arrangement of each pair of fingers 186.

The planet carrier 56 is positioned about the anvil 58 such that each of the five drive fingers 162 is located in a respective one of the five drive-finger receptor surfaces 104 (FIG. 12) of the anvil. In the assembled position, the rollers 174 are located within a space 163 (FIG. 13) between each adjacent pair of the drive fingers 162, with the space being sufficiently wide in a circular path, about the axis of the anvil 58, to allow limited free movement of the rollers in the circular path between the adjacent pairs of drive fingers 162. Since the ring 178 of the roller cage 176 is mounted for free movement relative to the ledge 174 of the fixed ring 72, the roller cage does not encumber the limited free movement of the rollers 174 in the circular path between adjacent drive fingers 162. As shown in FIG. 1, and as noted above, the planet carrier 56 is coupled to the motor 52 through the transmission 54.

The automatic spindle lock 33 of the drill 30 includes (1) the anvil 58 mounted on the spindle 38 for rotation therewith, (2) the flat surfaces 152 formed on the anvil and the receptor surfaces 104 formed on the periphery of the anvil, (3) the inner circular surface 74 of the ring 72 fixedly mounted to the housing 32, (4) the rollers 174 and (5) the roller cage 176 with each pair of parallel spaced fingers 186.

Referring to FIG. 12, during a period when the drill 30 is not in use, and is not being manipulated to operate the automatic spindle lock, the elements of the drill assume a "free" mode position, which is a first of three mode positions assumed by the fingers 162. The second and third mode positions are the above-noted "spindle lock" mode position and a "motor engaged" mode position, respectively. In the free mode position, the drive fingers 162 are located such that a central portion of the convex surface 170 of each drive finger is centrally radially positioned within the respective receptor surface 104 of the anvil 58. Also in the free mode position, the roller cage 176 is positioned with respect to the anvil 58 such that the rollers 174 are located in the middle of the respective flat surface 152 of the anvil, generally equally between spaced adjacent drive fingers 162, which are also spaced slightly from adjacent arms 186 of the roller cage.

Assume now that the operator wishes to mount the bit 44 (FIG. 1) in the chuck 42, in preparation for a drilling operation. The user holds the housing 32 of the unoperated drill 30 in one hand and, with the other hand, turns the chuck 42 slightly in either rotary direction about the axis of the chuck. Since the chuck 42 is mounted on the spindle 38, and the anvil 58 is also mounted on the spindle, the anvil will also turn slightly when the user turns the chuck slightly. As noted above, the rollers 174 are mounted for limited free movement in the circular path within the space 163. When the chuck 42 is turned slightly, each of the rollers 174 is slightly relocated from its free mode position (FIG. 12), on the respective flat surface 152 of the anvil 58, to a position near one end of the respective flat surface, as shown in FIG. 14, whereby the drill 30 is placed in a wedged mode.

In this relocated, wedged-mode position, each roller 174 becomes wedged between the respective flat surface 152 of the anvil 58, referred to as the movable wedging surface, and the adjacent portion of the inner circular surface 74 of the fixed ring 72, referred to as the fixed wedging surface. The wedging of the rollers 174 in this manner automatically locks the spindle 38 with the housing 32 in the "spindle locked" mode position (FIG. 14), to preclude rotational movement of the chuck 42 relative to the housing.

Thereafter, the operator inserts the shank 46 of the bit 44 into the bit-receiving opening of the chuck, and manipulates the jaw-positioning facility of the chuck to position the jaws 51 in a clamping position about the shank as shown in FIG. 1. During normal use of the drill 30, the operator presses the bit 44 into the workpiece 50 whereby the automatic brake 35, if included in the drill 30, is released by moving the brake collar 206 away from the brake disk 196, as shown in FIG. 16. The operator then depresses the trigger 70 to operate the motor 52, resulting ultimately in the rotation of the chuck 42 and the bit 44, whereafter the operator urges the rotating bit into the workpiece 50.

During operation of the drill 30, the planet carrier 56 and the drive fingers 162 are being rotated in a given direction, such as, for example, counterclockwise as indicated by the arrow in FIG. 13. The relative position between the drive fingers 162 and the respective concave receptor surfaces 104, in FIG. 13, represent the motor engaged mode position thereof. While each drive finger 162 functions in the same manner as the other four drive fingers, in the immediately following portion of the description, reference will be made primarily to an adjacent pair of the drive fingers 162*a* and 162*b* to describe the relationship between the fingers and other elements of the drill 30.

In the direction of rotation illustrated in FIG. 13, one drive finger, such as, for example, the drive finger 162*a*, will be referred to as the leading drive finger, and an adjacent drive finger, such as, for example, the drive finger 162*b*, will be referred to as the trailing drive finger. Each of the nests 182 of the roller cage 176, such as, for example, the nest 182*a*, is located within a respective one of the spaces 163, for limited free movement, as noted above, between the leading finger 162*a* and the trailing finger 162*b*.

Referring further to FIG. 13, when the drill 30 is being used in the manner described above, a forward section 165 of each of the fingers 162 of the planet carrier 56, such as, for example, the finger 162*b*, is moved to a forward portion of the respective receptor surface 104 of the anvil 58, where the fingers collectively apply a driving force to the anvil. The locating of the forward section 165 of each of the fingers 162 represents the "motor engaged" mode position (FIG. 13).

In addition to engaging a forward portion of each receptor surface 104, the forward section 165 of each of the trailing fingers 162, for example, the finger 162*b*, engages an adjacent finger, for example, the finger 186*a*, of one of the nests 182, for example, the nest 182*a*, to simultaneously and collectively apply a driving force to the roller cage 176. In this manner, the anvil 58 and the roller cage 176 are driven together at the same rotational speed.

When the drilling operation is complete, the operator extracts the bit 44 from the workpiece 50 and releases the trigger 70 to thereby remove the operating power from the motor 52, whereby the driving force is withdrawn from the planet carrier 56 and the drive fingers 162. It is noted that prior to extracting the bit 44 from the workpiece 50, the operator could operate the drill 30 in a reverse mode, and extract the bit during this mode.

In any event, when the trigger 70 is released, the rotational speed of the planet carrier 56 and the fingers 162 cease to be driven whereby the rotational speed thereof gradually decreases in a slowing mode. Since the anvil 58 is not attached to the drive fingers 162, and because the circular distance of each of the spaces 163 allows for limited movement of the respective nests 182, then the anvil, the spindle 38, the chuck 42 and the bit 44 continue to coast, at a rotational speed greater than the slowing speed of the planet carrier 56. During this period, the finger 186*b* of each of the nests 182, for example, the nest 182*a*, eventually engages an adjacent trailing portion of the slowing respective leading drive finger, such as, for example, the finger 162*a*, whereby the nests are rebounded toward the trailing drive finger 162*b*. This rebounding action is repetitive and continues for a brief period, during which a chattering noise occurs and does not stop until rotation of the elements of the drill 30 have ceased.

If the roller cage 176 and the nests 182 were not present during the rebounding action, the rollers 174 could become skewed and lodged in a position, within the respective spaces 163, which would be non-parallel with the axis of the anvil 58, The skewed and lodged position of the rollers 174 could preclude eventual normal and effective operation of the automatic spindle lock 33, which is necessary for the removal of the bit 44. However, with the presence of the roller cage 176 and the nests 182, the rollers 174 are allowed to encounter the above-noted repetitive bouncing action during the coasting of the anvil 58, but will be maintained in parallel with the axis of the anvil during the coasting period. Thus, when the operator again operates the automatic spindle lock 33 as described above, the rollers 174 are in position to accomplish an effective and efficient operation of the lock.

If the drill 30 is equipped with the automatic brake 35, the spindle 38 is braked in the manner described above. In the event there is any chattering noise occurring during the period when the rollers 174 are being bounced between the forward leg 162*a* and the trailing leg 162*b*, the operation of the automatic brake 33 will quickly stop the coasting of the spindle 38 and thereby effectively reduce the period during which the noise occurs.

It is noted that the automatic spindle lock 33 functions independently of the automatic brake 35. Thus, the automatic spindle lock 33 maintains the parallel alignment of the rollers with the axis of the anvil 38 regardless of the presence, or absence, of the automatic brake 35.

Referring to FIGS. 2 and 16, as noted above, the metal element 76 and the compliant element 78 are assembled to form the anvil 58 such that the circular outer surfaces 128 (FIG. 5) of the lugs 120 and 122 of the compliant element 78 extend radially outward beyond the radial location of the respective concave receptor surfaces 104. With this arrangement, when the anvil 58 is assembled within the housing 32, the circular outer surfaces 128 are located to engage portions of the convex surfaces 172 (FIG. 12) of the drive fingers 162. When the motor 52 is operating, the planet carrier 56 is driving the anvil 58 and the roller cage 176 so that all elements are rotating at the same speed as described above. Therefore, there is no relative rotational movement between the outer surfaces 128 of the lugs 120 and 122 and the fingers 162 of the planet carrier 56.

However, when operating power is removed from the motor 52, the unpowered planet carrier 56 is rotating at the slowing speed which is less than the coasting speed of the anvil 58, as described above. At this time, there is relative rotation between the outer surfaces 128 of the compliant lugs 120 and 122, and adjacent portions of the fingers 162 of the slowing planet carrier 56. This action results in the operation of the automatic drag system 37 whereby the movement of the compliant outer surfaces 128 relative to the fingers 162 applies a drag or resistance to the anvil 58 tending to slow the coasting anvil to a slowing speed somewhat consistent with that of the planet carrier 56. In this context, the surfaces 128 serve as drag surfaces.

In addition, as shown in FIGS. 2 and 16, the compliant O-ring 119 is in engagement with the wall surface of the annular groove 118 and extends outward therefrom into engagement with the wall surface of the central opening 132*a* of the planet carrier 56. Thus, the O-ring 119 provides a compliant intermediary between the planet carrier 56 and the anvil 58. As long as the planet carrier 56 and the anvil 58 are rotating at the same speed, there is no relative rotation between the O-ring 119 and the wall surface of the central opening 132*a*. However, when operating power is removed from the motor 52, the presence of the compliant O-ring 119 between the faster rotating anvil 58 and the slower rotating planet carrier 56 results in the application of a drag or resistance to the anvil 58 tending to slow the coasting anvil to a slowing speed somewhat consistent with that of the planet carrier 56. In this context, the portions of the O-ring 119, which engage the planet carrier 56, also function as drag surfaces.

The automatic drag system 37 could include either (1) the compliant element 78, being positioned for engagement with the fingers 162, or (2) the compliant O-ring 119 being positioned in the annular groove 118 and in engagement with the wall surface central 132*a* of the planet carrier 56, or (3) could include both (1) and (2) above.

Referring again to FIG. 15, in conjunction with the second embodiment planet carrier 129, a second embodiment of an anvil 144 is shown with a central axial opening 146 having four axially aligned grooves 148, with each groove being spaced from the two adjacent grooves by ninety degrees. Further, adjacent grooves 148 are joined by four respective curved surfaces 150. The grooves 148 and the curved surfaces 150 extend axially between opposite ends of the anvil 144.

The anvil 144 is formed with three flat surfaces 152 spaced equally about the periphery of the anvil, with each flat surface forming a movable wedging surface. The anvil 144 is also formed with three concave drive-finger receptor surfaces 154, each of which is interspersed between adjacent pairs of the flat surfaces 152. The three flat surfaces 152, and the concave surfaces 154, extend in an axial direction between opposite ends of the anvil 144, and are each referred to as a movable wedging surface. It is noted that the anvil 144 could be formed with a central axial opening identical to the central axial opening 80 (FIG. 6) of the anvil 58 instead of the central axial opening 146 (FIG. 12) of the anvil 144.

A second embodiment roller cage 220 is formed, for example, by casting or molding, with a circular band 222 and three integral pairs of cage fingers 224. Each pair of fingers 224 are spaced to receive a respective one of three wedging rollers 226 therebetween. Adjacent pairs of the cage fingers 224 are spaced from each other for receipt of the drive fingers 140 therebetween.

The second embodiment elements, such as the planet carrier 129, the anvil 144, the roller cage 220, the rollers 226, a ring 228, which is similar to the ring 72 (FIG. 12), and a spindle 230 can be assembled in the housing 32 of the drill 30, and function in the same manner as that described above with respect to the first embodiment elements.

Figure 8:
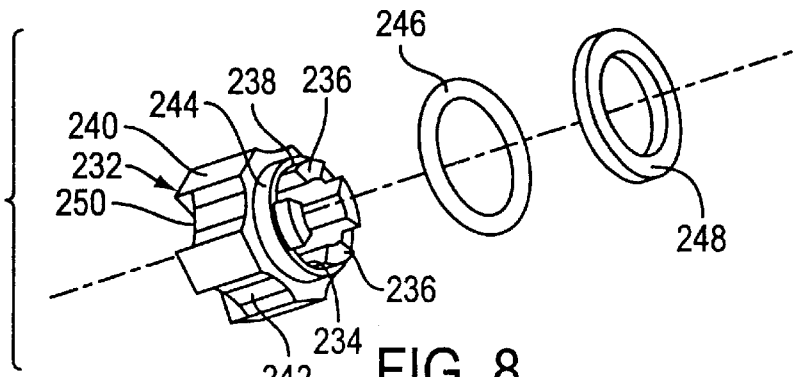
FIG. 8 is a perspective view showing details of a first section of a second embodiment of an anvil, in accordance with certain principles of the invention.

Referring to FIG. 8, another embodiment of a metal anvil element 232, for use as a component of the automatic drag system 33, is formed with a central axial opening 234 having four spaced axially-directed ribs 236 which define a central opening structure similar to that of the central axial opening 146 (FIG. 15). The ribs 236 extend axially outward from within the central opening 234 at one end 238 thereof. The periphery of the anvil 232 is formed with five spaced flat surfaces 240 and five spaced drive-finger concave receptor surfaces 242. An annular ledge 244 is formed concentrically about the axis of the central opening 234 at the end 238 of the anvil element 232, which is radially outward from the ribs 236, but radially inward of the flat surfaces 240 and the receptor surfaces 242. A compliant O-ring 246, which could be composed of rubber or any suitable compliant material, is placed over the annular ledge 244, and a metal ring 248 is press fit onto, or otherwise firmly secured about, the radially outward portions of the extended ends of the ribs 236 to form an axial element which is functionally similar to the metal element 76 with the compliant O-ring 119. The compliant element 78 could be assembled with an end 250 of the anvil element 232, opposite the end 238, in the same manner that the compliant element 78 is assembled with the metal element 76.

The preferred embodiment of the drill 30 is formed by the automatic spindle lock 33, which includes the anvil 58, and the automatic drag system 37, which includes the anvil 58.

In general, the above-identified embodiments are not to be construed as limiting the breadth of the present invention. Modifications, and other alternative constructions, will be apparent which are within the spirit and scope of the invention as defined in the appended claims.

What is claimed is:

1. A power driven rotary device, which comprises:

a housing having at least one fixed wedging surface;

a drive carrier mounted for rotation within the housing;

a powered driver located within the housing for rotating the drive carrier;

a drivable output member formed with an axis and located within the housing and mounted therein for rotation;

the drivable output member including at least one movable wedging surface located in spatially facing relation to the fixed wedging surface;

the drive carrier for rotating the drivable output member upon rotation of the drive carrier;

at least one wedging element formed with an axis and located for free movement between the fixed wedging surface and the at least one movable wedging surface for movement with the drive carrier and the drivable output member when the drive carrier and the drivable output member are rotating at substantially the same speed, and for being wedged between the fixed wedging surface and the at least one movable wedging surface in a wedging mode when the drivable output member is rotating at a speed different from the speed of the drive carrier to lock the drivable output member with the housing; and means for maintaining the axis of the at least one wedging element in a prescribed orientation relative to the axis of the drivable output member.

2. The power driven rotary device as set forth in claim 1, wherein the drive carrier is formed with a portion which rotates in a circular path about an axis of the device, and which further comprises:

the means for maintaining is formed with portions which are located in the circular path of, and engageable with, the drive carrier.

3. The power driven rotary device as set forth in claim 1, wherein the at least one wedging element is formed with a prescribed length and the means for maintaining is formed with a nest which is located in interfacing relation with portions of the at least one wedging element along the prescribed length.

4. The power driven rotary device as set forth in claim 1, wherein the at least one wedging element is formed about the axis thereof, and wherein the means for maintaining includes at least one blocking member which is positioned to preclude transaxial movement of the at least one wedging element in the direction of the at least one blocking member.

5. The power driven rotary device as set forth in claim 4, wherein the at least one blocking member covers an adjacent portion of the at least one wedging element while other spaced portions of the at least one wedging element remain uncovered for wedging engagement with the fixed wedging surface and the at least one movable wedging surface.

6. The power driven rotary device as set forth in claim 1, wherein the means for maintaining is movable independently of the fixed wedging surface and the at least one wedging surface.

7. The power driven rotary device as set forth in claim 1, wherein the drivable output member comprises:

an output element located along an axis of the device for rotation; and a coupler mounted on the output element for engagement with the drive carrier to couple rotational drive from the powered driver to the drivable output member.

8. The power driven rotary device as set forth in claim 7, wherein the at least one wedging surface is formed on the coupler.

9. The power driven rotary device as set forth in claim 7, which further comprises:

a drag surface on the coupler which is in engagement with an adjacent portion of the drive carrier to present a drag on the rotational movement of the output element when the speed of the output element is different from the speed of the drive carrier.

10. The power driven rotary device as set forth in claim 9, wherein the coupler comprises:

a first section having an axis and composed of a first material;

a second section having an axis and composed of a second material different from the first material;

the first section joined with the second section with the axes thereof in alignment; and an exterior portion of the second section forming the drag surface and being in engagement with the adjacent portion of the drive carrier.

11. The power driven rotary device as set forth in claim 9, wherein the drag surface is formed by a band which is located about the coupler and is in engagement with the drive carrier.

12. The power driven rotary device as set forth in claim 1, which further comprises:

a drag surface located on at least a portion of the drivable output member which is in engagement with an adjacent portion of the drive carrier to present a drag on the rotational movement of the drivable output member when the speed of the drivable output member is different from the speed of the drive carrier.

13. The power driven rotary device as set forth in claim 12, which further comprises:

means responsive to the drivable output member being driven in an unloaded rotational mode for applying a braking force to the drivable output member; and means responsive to the drivable output member being driven in a loaded rotational mode for removing the braking force from the drivable output member.

14. The power driven rotary device as set forth in claim 13, wherein the means for applying a braking force comprises:

a brake disk fixedly mounted within the housing;

a brake collar mounted on the drivable output member and rotationally and axially movable therewith; and a biasing element which normally urges the drivable output member in an axial direction to place the brake collar in braking engagement with the brake disk.

15. The power driven rotary device as set forth in claims 14, wherein the means for removing the braking force comprises:

a pair of spaced supports for supporting the drivable output member for rotational and axial movement relative to the pair of supports; and the biasing element being movable to allow axial movement of the drivable output member, to thereby move the brake collar out of engagement with the brake disk.

16. The power driven rotary device as set forth in claim 1, which further comprises:

means responsive to the drivable output member being driven in an unloaded rotational mode for applying a braking force to the drivable output member; and means responsive to the drivable output member being driven in a loaded rotational mode for removing the braking force from the drivable output member.

17. The power driven rotary device as set forth in claim 16, wherein the means for applying a braking force comprises:

a brake disk fixedly mounted within the housing;

a brake collar mounted on the drivable output member and rotationally and axially movable therewith; and a biasing element which normally urges the drivable output member in an axial direction to place the brake collar in braking engagement with the brake disk.

18. The power driven rotary device as set forth in claim 17, wherein the means for removing the braking force comprises:

a pair of spaced supports for supporting the drivable output member for rotational and axial movement relative to the pair of supports; and the biasing element being movable to allow axial movement of the drivable output member, to thereby move the brake collar out of engagement with the brake disk.

19. A power driven rotary device, which comprises:

a housing having a plurality of fixed wedging surfaces at spaced locations about an axis of the device;

a drive carrier mounted for rotation within the housing;

a powered driver located within the housing for rotating the drive carrier;

an output member having at least portions located within the housing and mounted therein for rotation;

a coupler attached to the output member for rotation therewith and formed with a plurality of coupler wedging surfaces at spaced locations about the coupler;

each of the plurality of fixed wedging surfaces being located spatially adjacent a respective one of the plurality of coupler wedging surfaces to form a plurality of pairs of opposed wedging surfaces;

the drive carrier movable into engagement with the coupler for rotating the output member upon rotation of the drive carrier;

a plurality of wedging rollers, each of which is located for free movement between a respective one of the plurality of pairs of opposed wedging surfaces; and a roller cage positioned about portions of each of the plurality of wedging rollers to preclude skewed movement of the wedging rollers in a transaxial direction.

20. The power driven rotary device as set forth in claim 19, wherein the roller cage comprises:

a support member;

a plurality of pairs of nests formed with the support member; and each of the plurality of nests formed to receive one of the plurality of wedging rollers.

21. The power driven rotary device as set forth in claim 20, wherein each of the plurality of nests comprises:

a pair of legs which are spaced to receive a respective one of the plurality wedging rollers therebetween.

22. The power driven rotary device as set forth in claim 19, wherein the roller cage comprises:

a circular band having a side surface;

a plurality of pairs of spaced legs extending from the side surface of the circular band; and each of the pairs of spaced legs being spaced apart a distance sufficient for receipt of the respective wedging roller therebetween.

23. The power driven rotary device as set forth in claim 19, wherein the roller cage comprises:

a circular band formed about an axis thereof and having an inner circular surface facing the axis;

a plurality of ears formed with and extending radially inward from the inner circular surface of the circular band;

each of the plurality of ears formed with spaced side edges on opposite sides thereof;

a finger formed with and extending from each of the side edges of the plurality of ears to form a plurality of pairs of opposed fingers spaced for receipt of a respective one of the plurality of wedging rollers; and the plurality of pairs of opposed fingers extending in a common axial direction.

24. A power driven rotary device, which comprises:

a housing;

a drive carrier mounted for rotation within the housing;

a powered driver located within the housing for rotating the drive carrier;

a drivable output member having at least portions located within the housing and mounted therein for rotation;

the drive carrier movable into engagement with, and for rotating, the drivable output member upon rotation of the drive carrier; and a drag surface located on at least a portion of the drivable output member which is in engagement with an adjacent portion of the drive carrier to present a drag on the rotational movement of the drivable output member when the speed of the drivable output member is different from the speed of the drive carrier.

25. The power driven rotary device as set forth in claim 24, wherein the drivable output member comprises:

an output element located along an axis of the device for rotation;

a coupler mounted on the output element for engagement with the drive carrier to couple rotational drive from the powered driver to the output element; and the drag surface is on the coupler and is in engagement with an adjacent portion of the drive carrier to present a drag on the rotational movement of the coupler and the output element when the speed of the output element is different from the speed of the drive carrier.

26. The power driven rotary device as set forth in claim 25, wherein the coupler comprises:

a first section having an axis and composed of a first material;

a second section having an axis and composed of a second material different from the first material;

the first section joined with the second section with the axes thereof in alignment; and an exterior portion of the second section forming the drag surface and being in engagement with the adjacent portion of the drive carrier.

27. The power driven rotary device as set forth in claim 25, wherein the drag surface is formed by a band which is located about the coupler and is in engagement with the drive carrier.

28. A power driven rotary device, which comprises:

a housing;

a drive carrier mounted for rotation within the housing;

a powered driver located within the housing for rotating the drive carrier;

a drivable output member having at least portions located within the housing and mounted therein for rotation;

the drive carrier movable into engagement with, and for rotating, the drivable output member upon rotation of the drive carrier;

means responsive to the drivable output member being in an unloaded mode for applying a braking force to the drivable output member; and means responsive to the drivable output member being in a loaded mode for removing the braking force from the drivable output member.

29. The power driven rotary device as set forth in claim 28, wherein the means for applying a braking force comprises:

a brake disk fixedly mounted within the housing;

a brake collar mounted on the drivable output member and rotationally and axially movable therewith; and a biasing element which normally urges the drivable output member in an axial direction to place the brake collar in braking engagement with the brake disk.

30. The power driven rotary device as set forth in claim 29, which further comprises:

a pair of opposed slots formed internally of the housing;

a pair of ears formed on opposite edge portions of the brake disk and extending in a common direction; and the ears of the brake disk being fixedly located in the pair of slots formed in the housing.

31. The power driven rotary device as set forth in claim 29, which further comprises:

a braking pad formed on a surface of the brake collar which interfaces, and is engageable, with the brake disk.

32. The power driven rotary device as set forth in claim 29, which further comprises:

a limiting collar formed on the drivable output member and movable therewith at least in an axial direction;

the biasing element is a compression spring having a first end and a second end;

the first end of the compression spring being positioned at a fixed location within the housing spaced from the limiting collar; and the second end of the compression spring being positioned in engagement with the limiting collar.

33. The power driven rotary device as set forth in claim 32, the compression spring being in a comparatively expanded state when the drivable output member is in a no load condition whereby the spring is urging the drivable output member in a first direction; and the compression spring being in a compressed state when the drivable output member is moved, under a load condition, axially in a second direction opposite the first direction whereby the limiting collar is moved toward the fixed location of the first end of the compression spring.

34. The power driven rotary device as set forth in claim 33, which further comprises:

a stop positioned in the path of the limiting collar to limit the distance the drivable output member can be urged in the first direction.

35. The power driven rotary device as set forth in claim 28, wherein the means for removing the braking force comprises:

a pair of spaced supports for supporting the drivable output member for rotational and axial movement relative to the pair of supports; and the biasing element being movable to allow axial movement of the drivable output member, to thereby move the brake collar out of engagement with the brake disk.

36. A power driven rotary device, which comprises:

a housing;

a non-rotatable surface located fixedly in the housing and facing a rotary-device axis of the rotary device;

at least a portion of the non-rotatable surface forming a fixed wedging surface;

a drive carrier mounted for rotation about the rotary-device axis and within the housing;

a drivable output member having at least portions located within the housing and mounted therein for rotation along the rotary-device axis;

the drivable output member formed with an output-member surface which is spatially facing the non-rotatable surface;

the output-member surface formed with a movable wedging surface locatable in spatially facing relation to the fixed wedging surface;

the drive carrier movable into engagement with, and for rotating, the drivable output member upon rotation of the drive carrier;

a wedging element extending along a wedging-element axis and located for independent movement between, and formed with respective spaced surfaces which directly interface with, the non-rotatable surface and the output-member surface;

the wedging element locatable in a non-wedging mode between the non-rotating surface and the output-member surface for movement with the drive carrier and the drivable output member when the drive carrier and the drivable output member are rotating at substantially the same speed;

the wedging element locatable between the fixed wedging surface and the movable wedging surface in a wedging mode when the drivable output member is rotating at a speed different from the speed of the drive carrier to lock the output member with the housing; and a nest formed with structure for receipt of the wedging element therein in a prescribed orientation to maintain the wedging-element axis substantially parallel with the rotary-device axis during the non-wedging and wedging modes.

37. The power driven rotary device as set forth in claim 36, which further comprises:

the structure of the nest being formed to receive the wedging element to maintain the respective spaced surfaces of the wedging element in direct interface with the non-rotatable surface and the output-member surface during the non-wedging and wedging modes.

38. The power driven rotary device as set forth in claim 37, wherein the structure of the nest comprises:

a ring having a ring axis and an inner side wall facing the ring axis;

an ear formed on the inner side wall toward the ring axis;

a pair of spaced fingers extending in parallel in a common direction from, and perpendicular to, the ear and spaced apart for receipt of the wedging element therebetween, where the spaced fingers engage portions of the surface of the wedging element exclusive of the respective spaced surfaces thereof.

39. The power driven rotary device as set forth in claim 36, wherein the structure of the nest comprises:

a ring having a ring axis and an inner side wall facing the ring axis;

a ear formed on the inner side wall and extending toward the ring axis;

a pair of spaced interfacing fingers extending in parallel from, and perpendicular to, the ear and spaced apart for receipt of the wedging element therebetween.

40. The power driven rotary device as set forth in claim 36, wherein the structure of the nest is in engagement with the wedging element to maintain, during the wedging mode, all surface portions of the wedging element (1) which are immediately adjacent the fixed wedging surface in full engagement therewith, and (2) which are immediately adjacent the movable wedging surface in full engagement therewith.

* * * * *